United States Patent [19]

Rebel et al.

[11] Patent Number: 5,005,474

[45] Date of Patent: Apr. 9, 1991

[54] ATTACHMENT FOR A DAMPING UNIT OF AN OFFSET PRINTING PRESS

[75] Inventors: Herbert Rebel, Rodgau; Peter Hummel, Offenbach am Main, both of Fed. Rep. of Germany

[73] Assignee: MAN Roland Druckmaschinen AG, Fed. Rep. of Germany

[21] Appl. No.: 491,345

[22] Filed: Mar. 9, 1990

[30] Foreign Application Priority Data

Mar. 13, 1989 [DE] Fed. Rep. of Germany ..... 3908045

[51] Int. Cl.[5] ..... B41F 7/26; B41F 7/40; B41L 25/02

[52] U.S. Cl. ..... 101/148

[58] Field of Search ..... 101/148, 147, 350, 351, 101/352, 349, 207-210, DIG. 38

[56] References Cited

U.S. PATENT DOCUMENTS 4,130,057 12/1978 List .
4,385,559 5/1983 Jarach ..... 101/DIG. 38

FOREIGN PATENT DOCUMENTS 2649003 5/1978 Fed. Rep. of Germany .
144155 10/1980 Fed. Rep. of Germany .

*Primary Examiner*—J. Reed Fisher
*Attorney, Agent, or Firm*—Leydig, Voit & Mayer

[57] ABSTRACT

An attachment which can be fitted subsequently to the damping roller of an existing damping unit in order to obviate mottling includes a mounting frame in which tandem distributing rollers are mounted radially of a common damping roller for resilient movement and are driven thereby in the peripheral direction by friction. A coupling member on the frame is adapted to be coupled with or released from an existing bearing lever of the damping unit and a drive mechanism produces axial reciprocation of the frame.

4 Claims, 4 Drawing Sheets

FIG. 3
A-A
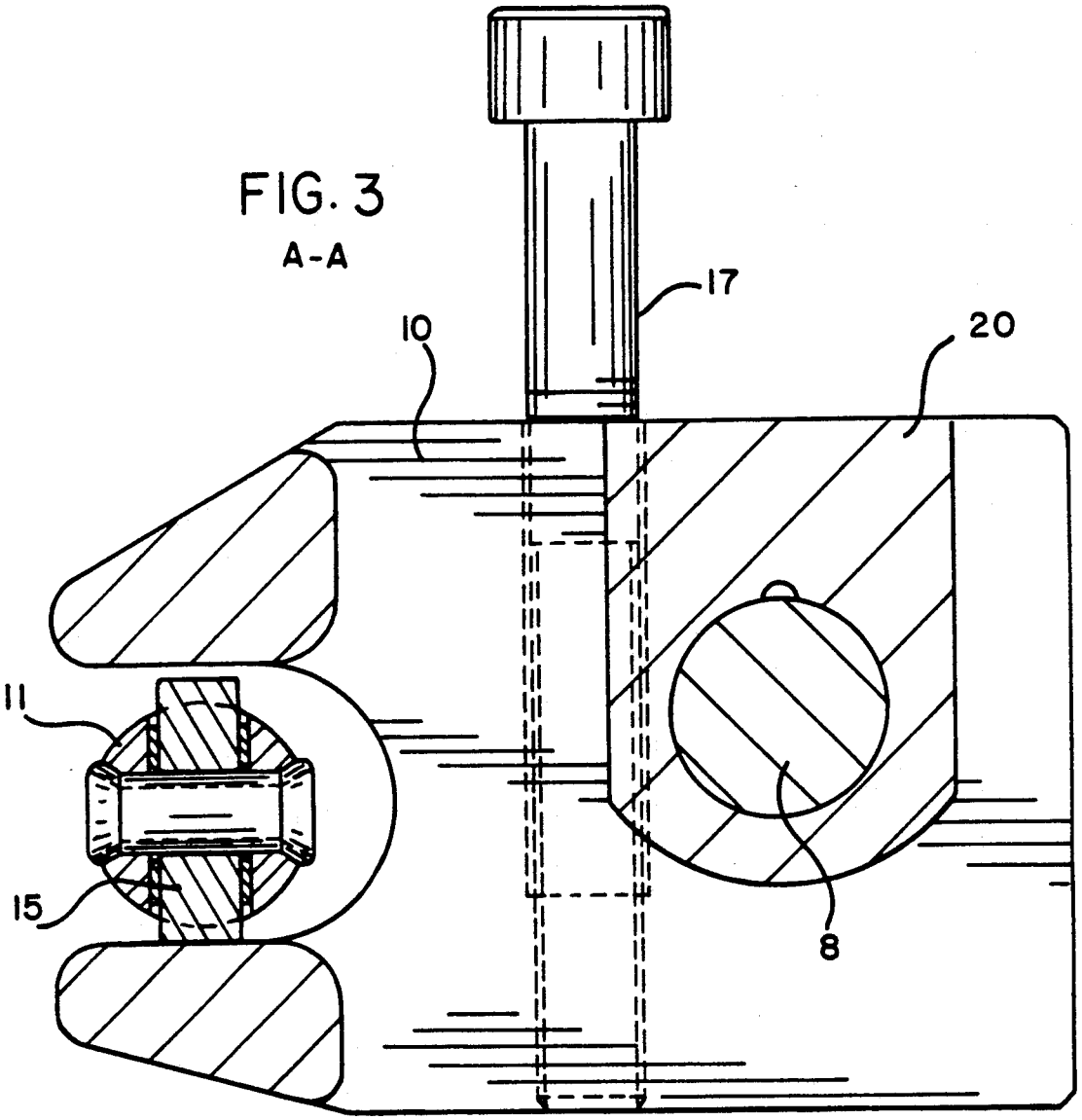
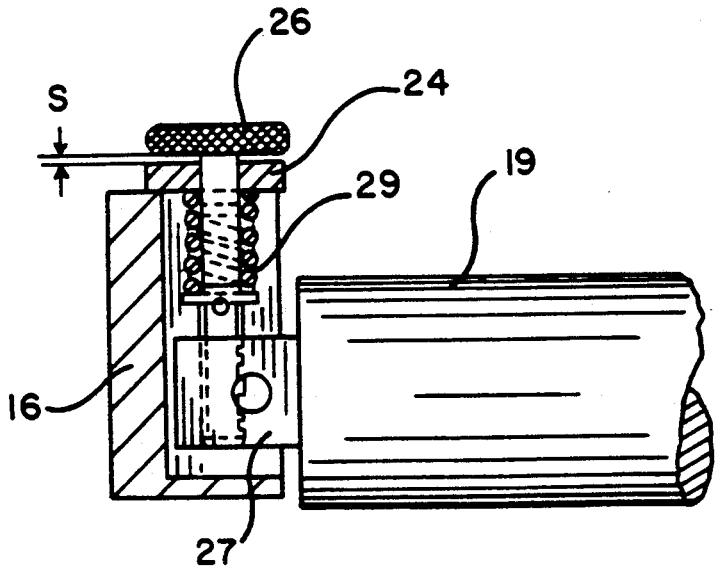
FIG. 4
C-C

ATTACHMENT FOR A DAMPING UNIT OF AN OFFSET PRINTING PRESS

FIELD OF THE INVENTION

The present invention relates generally to damping units of offset printing presses and more particularly concerns an attachment that may be subsequently added to the regular damping unit.

BACKGROUND OF THE INVENTION

One general arrangement for a damping unit of an offset printing press is disclosed in DE-PS 2,649,003 (see U.S. Pat. No. 4,130,057). The present invention constitutes an improvement in the form of an attachment that may be subsequently added.

It is also known in the art that a spreader may be coordinated with a damping unit such as is generally disclosed in DD 144,155. However, these arrangements usually involve essentially permanent components of the damping unit.

OBJECTS AND SUMMARY OF THE INVENTION

It is the primary object of the invention to provide an attachment adapted to be subsequently added to the regular damping unit so that excesses of damping fluid caused by blank parts of the plate cylinder may be compensated for effectively.

The invention is carried out by providing a mounting frame carrying first and second intermediate spreader rollers that may be quickly and conveniently installed in slotted bearing levers mounted on a distributing roller which engages the applicator roller and the damping feed roller of the press. The intermediate spreader rollers are frictionally driven by the applicator roller and coupling means carried on either side of the frame provide for coupling, uncoupling or completely disengaging the frame from the slotted bearing levers. A drive is provided for producing axial reciprocation of the frame and intermediate spreader rollers.

The advantage of the invention is that the attachment including the additional intermediate or tandem spreader rollers can be quickly and conveniently fitted subsequently to the existing damping unit. The attachment can therefore be used on an as-required basis, for instance, only for critical orders, and may be used in a printing press where special measures are needed to reduce mottling due to excesses of damping fluid caused by blank parts of the plate cylinder.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 3 is a section, on an enlarged scale, substantially as seen along line A—A in FIG. 2;

FIG. 4 is an enlarged, fragmentary section substantially as seen along line C—C in FIG. 1;

For the sake of simplification in the description hereinafter, like reference numerals denote like elements.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
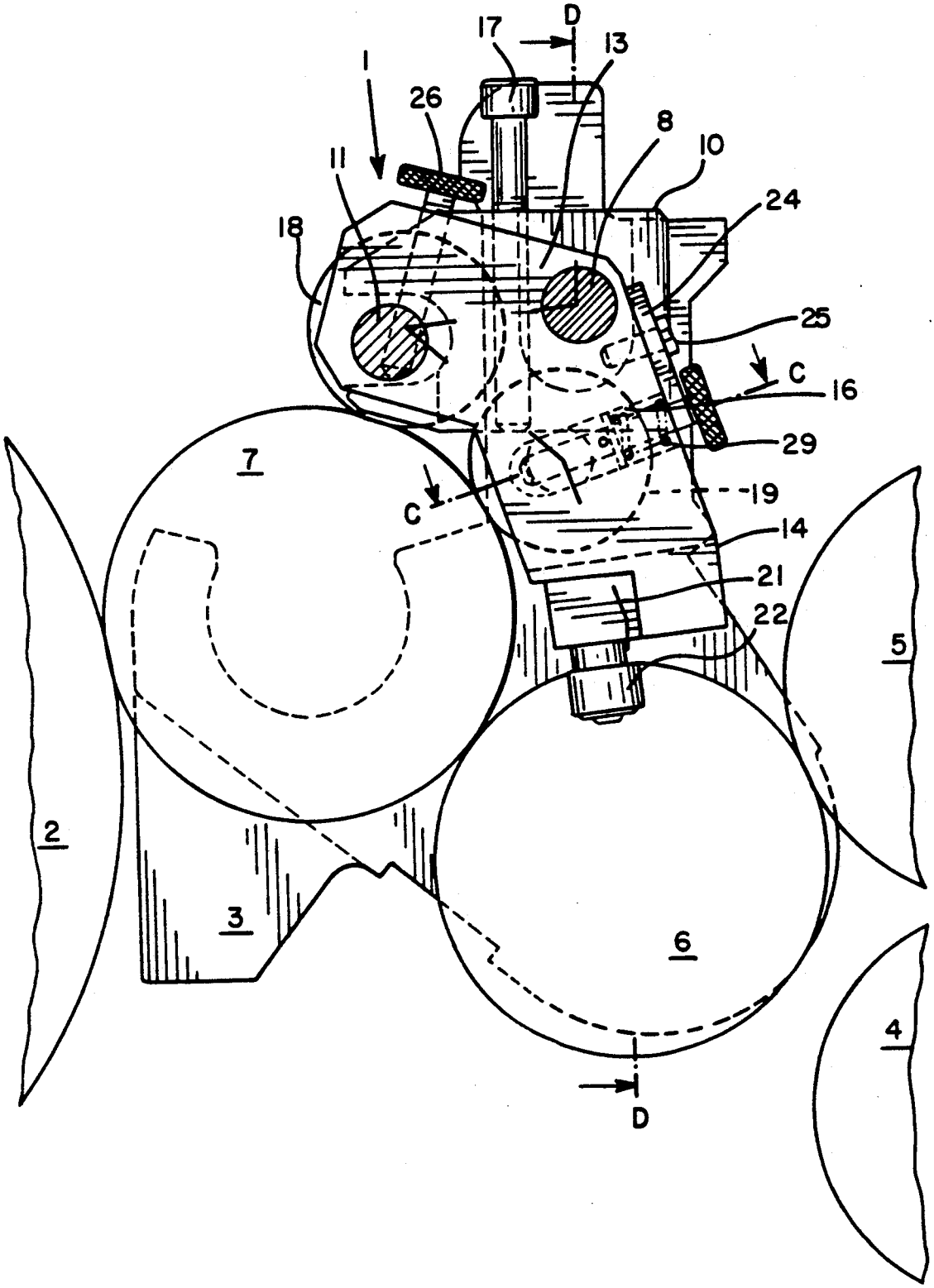
FIG. 1 is a somewhat schematic end view of a damping unit with the attachment according to the present invention disposed in its operative position.
Figure 2:
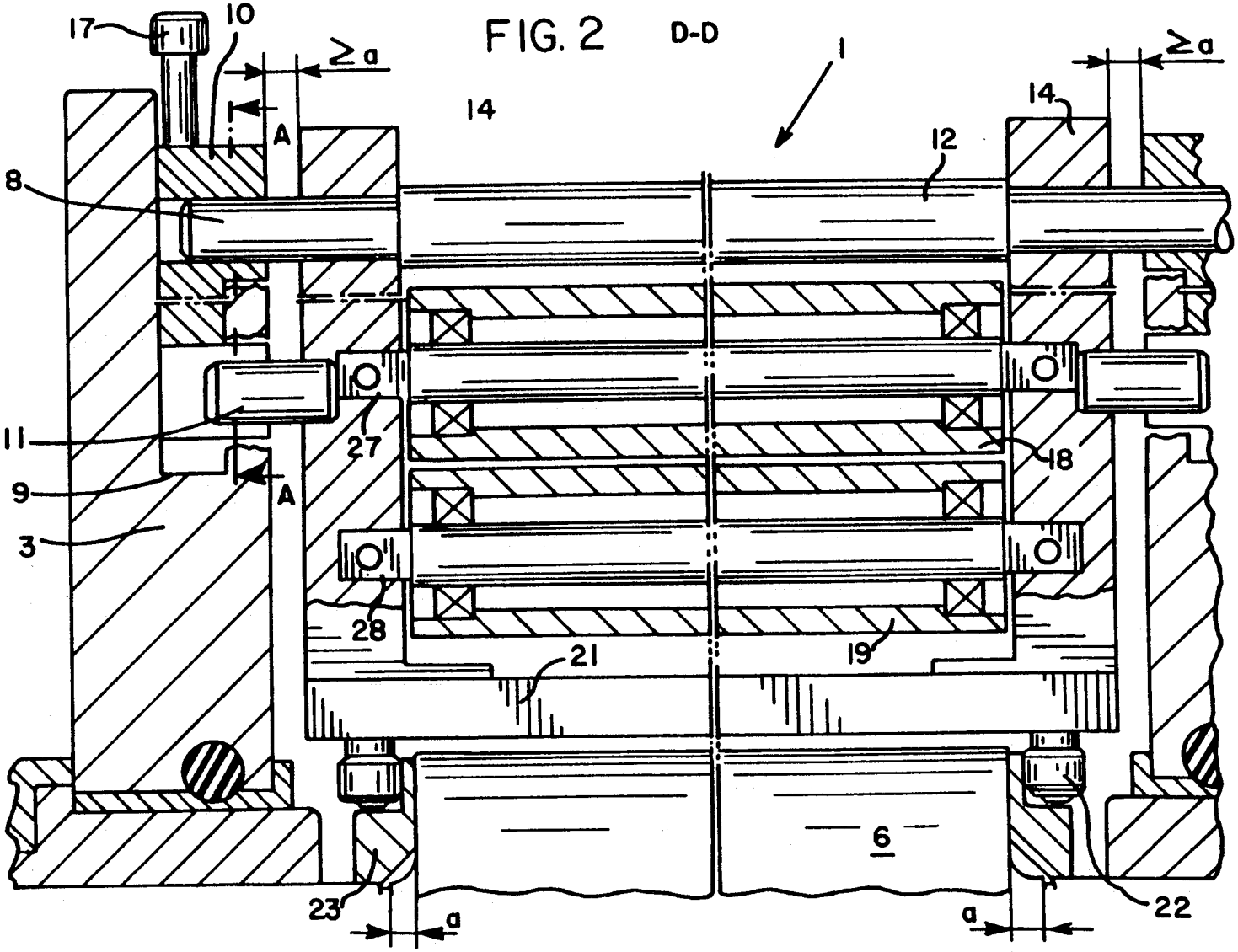
FIG. 2 is a fragmentary longitudinal cross-section substantially as seen along line D—D in FIG. 1.
Figure 6:
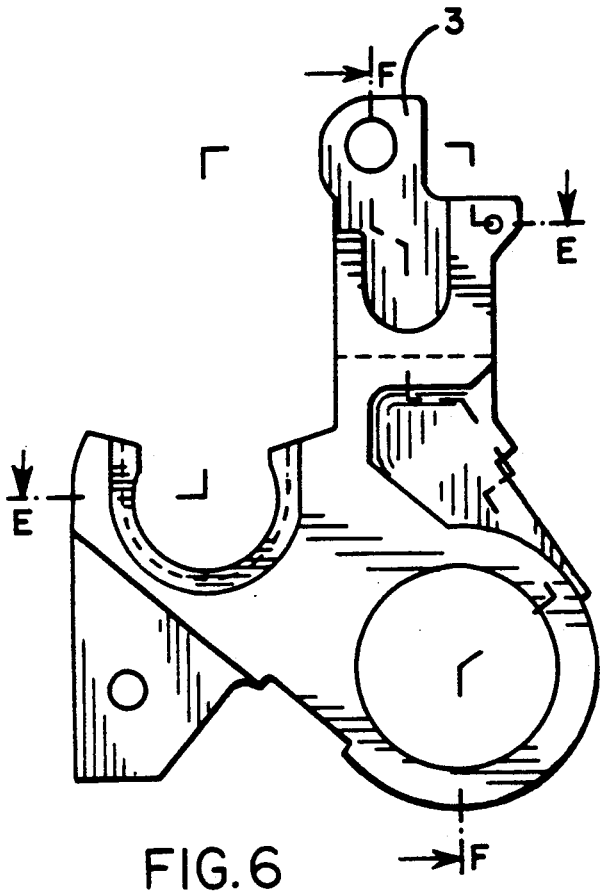
FIG. 6 is side elevation of the bearing lever.

Turning now to the drawings, FIG. 1 shows a portion of the damping unit for an offset printing press. Damping liquid is supplied to a printing plate on a plate cylinder 2 from a damping medium tank or the like by way of a continuously rotating duct roller 4, a dispensing roller 5, a distributing roller 6 and an applicator roller 7. The latter is mounted in a bearing lever 3 mounted eccentrically of the distributing roller 6.

The spindle of a pneumatic actuating piston (not shown) is pivotally connected to the lever 3, the piston being adapted to move the lever 3 into a disengaged position and into an engaged position. Since the lever 3 is mounted eccentrically, the applicator roller 7 is also disengaged from the distributing roller 6. Further details of this actuating arrangement can be gathered from the disclosure in DE-PS 2,649,003 (U.S. Pat. No. 4,130,057).

The attachment according to the invention has a mounting frame indicated generally at 1. The frame 1 includes vertical bearing plates 14 screwed or pinned together by a top cross-member 12 and a bottom cross-member 21 to complete the frame, with the plate 14 on either side receiving a pair of intermediate spreader rollers including a first spreader 18 and a second or tandem spreader 19. Beveled journals 27, 28 of the spreader rollers 18, 19 are received in guides 16 of the plate 14 so as to be axially immobile but movable radially by the force of a spring 29 relatively to the applicator roller 7. The shell of each of the spreader rollers 18, 19 is rotatably mounted on the roller spindles. The resilient contact pressure of the rollers 18, 19 is produced by the self-weight of the frame 1 so that the pressing between the rollers 18, 19 and the applicator roller 7 always remains the same. The spring 29 bears on a plate 24 secured by a screw 25 to the plate 14. As a result of a clearance between a screw 26 and the plate 24 the spreader rollers 18, 19 have backlash radially of the applicator roller 7, as can be seen in FIG. 4.

Figure 5:
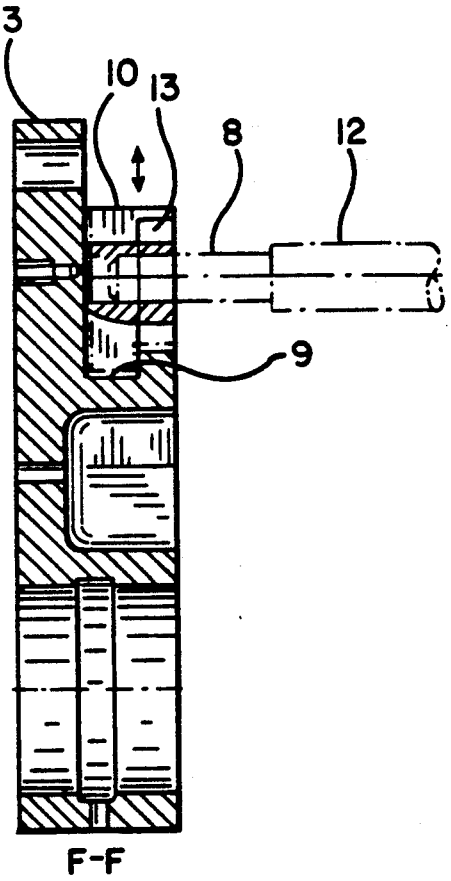
FIG. 5 is a somewhat diagrammatic view, partially in section substantially as seen along line F—F in FIG. 6 of the coupling part of the bearing lever.
Figure 7:
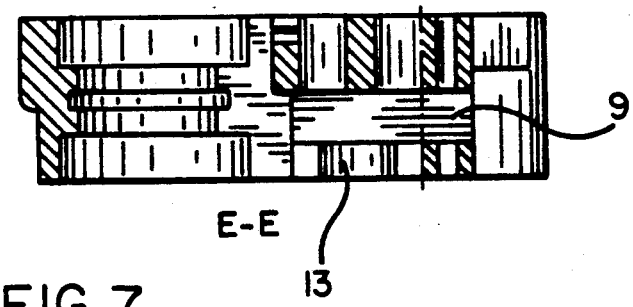
FIG. 7 is a section through the bearing lever substantially as seen along line E—E in FIG. 6.

Pursuant to the invention, the frame 1 is received by a coupling part 10 in the lever 3 with provision for radial movement relatively to the distributing roller 6 so as to be movable into and out of engagement, in the direction indicated by the arrow, and also to be disengageable in the event of a roller stoppage, as can be gathered from FIG. 5.

In the illustrated embodiment, the provision in the lever 3 for receiving the frame 1 comprises a slot 13 and a recess 9, the slot 13 receiving an eye 20 of the coupling part 10 in a positive engagement. The slot 13 and eye 20 secures the part 10 against rotation and the recess 9 secures the lateral position of the part 10.

In the frame 1 the part 10 is pushed laterally and externally on to pin 8 of cross-member 12. Pin 11 is secured to the bearing plate 14 and is provided with additional guide rollers 15 which bear on companion surfaces on the part 10. The rollers 15 thus prevent the attachment from being turned out of its operative position when the attachment is in its disengaged (stopped) position, as can be gathered from FIG. 3.

According to another aspect of the invention and also present in the frame 1, is a drive mechanism 22, 23 for producing an axial reciprocation of such a kind that the frame 1 with the intermediate spreader rollers 18, 19 can reciprocate laterally. To disengage the part 10 a screw 17 is provided which is disposed in the lever 3 in the direction of the slot 13.

In the preferred embodiment, the mechanism 22, 23 takes the form of a pair of cam rollers 22 which are secured to the bottom cross-member 21 and bear at both ends on cam discs 23 of the distributing roller 6 which is driven in conventional manner by the press so as to traverse laterally. The stroke of the distributor roller 6 can be stopped if required, in which event the spreader rollers 18, 19 act as rider rollers without axial distribution. It will also be appreciated that if it is required to inhibit differences in the profile of the ink on the applicator roller 7, at least one of the spreader rollers 18, 19 or rider rollers must have an ink-guiding surface.

From the foregoing, it will be understood that the attachment of the present invention enables additional or tandem rollers 18, 19 with lateral spreading to be disposed subsequently on an applicator roller of a damping unit of sheet offset presses in order to compensate for the excess of liquid due to reactions of the blank parts of the plate cylinder.

We claim as our invention:

1. An attachment for damping unit of an offset printing press having a plate cylinder and a damping unit including an applicator roller, a distributing roller and a slotted bearing lever, and wherein the applicator roller cooperates with the plate cylinder and the distributing roller and is mounted in the slotted bearing lever which is disposed on the distributing roller, said attachment comprising in combination, a mounting frame disposed on the slotted bearing lever adjacent the applicator roller and the distributing roller, said mounting frame including vertical bearing plates and a plurality of cross-members interconnecting the plates, first and second intermediate spreader rollers mounted in the bearing plates adjacent to and for engagement with the applicator roller, and spring means for permitting radial movement of the spreader rollers relative to the applicator roller, the intermediate spreader rollers being mounted on rotatable spindles and driven frictionally in the peripheral direction by the applicator roller during engagement of the intermediate spreader rollers and the applicator roller and resilient contact pressure between the intermediate spreader rollers and the applicator roller is produced by the weight of the mounting frame, a drive mechanism including means for producing axial reciprocation for the frame and the intermediate spreader rollers mounted within the slotted bearing lever, and coupling means carried on either side of the frame for coupling up, uncoupling or completely disengaging the frame bearing plates from the slotted bearing lever.

2. An attachment according to claim 1, wherein the distributing roller is mounted for axial reciprocation having a maximum stroke and the bearing plates are mounted on the bearing lever to define a gap between the bearing plates and lever greater than the maximum stroke of the axial reciprocation of the distributing roller.

3. An attachment according to claim 2, including coupling means for disengaging the attachment mounting frame from its operative position by means of a screw cooperating with the bearing lever slot, the coupling means including an eye which is guided non-rotatably on guide surfaces of the slot, the bearing lever being formed with recesses providing lateral staying of the coupling means, and the attachment bearing plates having pins with guide rollers disposed on the coupling means for securing the mounting frame against rotation around the center of one of said cross-members when the frame is in its disengaged or inoperative position.

4. An attachment according to claim 2, wherein the drive mechanism for producing axial reciprocation includes cam rollers secured to one of said cross-members of the attachment frame which are adapted to bear against cam discs mounted on either side of the axially reciprocating distributing roller of the damping unit.

* * * * *